United States Patent [19]

Haentjens et al.

[11] Patent Number: 4,913,619

[45] Date of Patent: Apr. 3, 1990

[54] CENTRIFUGAL PUMP HAVING RESISTANT COMPONENTS

[75] Inventors: Walter D. Haentjens; Thomas E. Stirling, both of Sugarloaf, Pa.

[73] Assignee: Barrett Haentjens & Co., Hazleton, Pa.

[21] Appl. No.: 229,293

[22] Filed: Aug. 8, 1988

[51] Int. Cl.[4] ..... F04D 29/16

[52] U.S. Cl. ..... 415/172.1; 415/173.6

[58] Field of Search ..... 415/170 A, 174, 197, 415/214, 172.1, 173.1, 173.3, 173.6

[56] References Cited

U.S. PATENT DOCUMENTS

| | | | |
|---|---|---|---|
| 834,848 | 10/1906 | Price | 415/197 X |
| 1,809,526 | 6/1931 | Namur | 415/170 A |
| 2,163,464 | 6/1939 | Llewllyn | 415/197 X |
| 2,365,058 | 12/1944 | Crawford | 415/197 X |
| 2,604,050 | 7/1952 | Wilson | 415/174 |
| 2,625,883 | 1/1953 | Howser | 415/170 A X |
| 2,949,321 | 8/1960 | Tracy | 415/170 A |
| 3,213,798 | 10/1965 | Carswell | 415/110 |
| 3,510,230 | 5/1970 | Raub | 415/170 A X |
| 3,633,926 | 1/1972 | Hryniszak et al. | 415/170 A X |
| 4,236,867 | 12/1980 | Morris | 415/26 |
| 4,242,039 | 12/1980 | Villard et al. | 415/112 |
| 4,245,952 | 1/1981 | Eberhardt | 415/170 A |
| 4,418,919 | 12/1983 | Wentworth | 415/174 X |
| 4,511,307 | 4/1985 | Drake | 415/170 A X |
| 4,655,684 | 4/1987 | Haentjens | 415/170 A |

FOREIGN PATENT DOCUMENTS

| | | | |
|---|---|---|---|
| 897907 | 5/1962 | United Kingdom | 415/197 |

*Primary Examiner*—Everett A. Powell, Jr.

*Attorney, Agent, or Firm*—Hill, Van Santen, Steadman & Simpson

[57] ABSTRACT

A centrifugal slurry pump includes wear resistant inserts on the wear faces of the first impeller shroud and the wear face of the front pump housing in the impeller chamber. The preferred embodiment provides hardened ceramic material inserts mounted in compression.

4 Claims, 2 Drawing Sheets

CENTRIFUGAL PUMP HAVING RESISTANT COMPONENTS

BACKGROUND OF THE INVENTION

1. Field of the Invention

The present invention relates generally to a centrifugal pump having wear resistant elements mounted on opposing wear prone faces of an impeller shroud and a pump housing 2. Description of the Related Art Centrifugal slurry pumps are known which include replaceable wear plates on the front and rear internal surfaces of the pump housing. Such replaceable wear plates are generally formed of hard, abrasion resistant material such as a hardened steel alloy.

A cantilevered centrifugal pump is disclosed in U.S. Pat. No. 4,655,684 in which internal faces of the pump housing are case hardened for increased wear resistance.

SUMMARY OF THE INVENTION

The present invention provides a centrifugal pump having reduced wear characteristics and a prolonged life by providing replaceable wear resistant components at the most wear prone locations in the pump. The invention also provides a centrifugal pump operable at optimum efficiency by controlling recirculation or leakage loss. The pump according to the present invention also reduces maintenance time required for impeller adjustment and for replacement of worn parts to obtain optimum pump performance. The invention provides an economical solution to wear in slurry pumps.

These and other objects and advantages of the present invention are obtained in a centrifugal pump having a shaft mounted impeller rotatably disposed within a housing wherein a first wear resistant member, or insert, is mounted in a wear prone face at a front internal surface within the housing and a second wear resistant member is mounted in an opposing wear prone face of a front shroud of the impeller. The wear resistant members are preferrably formed of an extremely hard, abrasion resistant material mounted in compression in the respective impeller shroud and housing surfaces. Such material is preferrably a super hard ceramic composite. The members, or inserts, are also preferrably replaceable to extend the life of the pump.

In a centrifugal slurry pump, the area of greatest water is the region adjacent the inlet where the impeller face is closely adjacent a stationary face of the pump housing. A recirculating, or leakage, flow occurs in this area as the result of reduced pressure at the inlet of the pump and increased pressure at the impeller outlet at opposite sides of this area. A forced flow through the area, potentially carrying abrasive solids from the slurry, thus, occurs. Wear in this region is, for example, three times greater than the wear occuring in the next most wear prone region of the pump.

The present invention provides replaceable inserts of extremely hard material in the regions of greatest wear on the front face, or shroud, of the impeller and on an opposing region in a wear face in the pump housing. The inserts of the present invention are provided in the region of closest running clearance at the suction side of the impeller. With hard wear resistant inserts according to the invention, the wear life of the front wear plate in the pump housing and the front shroud face of the impeller is prolonged to at least equal the wear life of the next most wear prone portion in the pump housing, which generally is a rear wear plate.

In one embodiment, the centrifugal pump is a cantilevered pump in which shaft runout, or lateral movement, is possible due to radial hydraulic forces operating on the impeller, the impeller being mounted on a shaft supported in bearings spaced from the impeller. In such application, the wear face diameter of the stationary wear resistant insert is greater than the diameter of the rotating wear resistant insert in the impeller.

The wear resistant inserts, or elements, of the instant invention are preferrably mounted in compression and, therefore, materials can be used which are hard and strong in compression but relatively weak in tension. Such wear resistant materials may include, but are not limited to, ceramic composites such as ceramic composites in the family of silicon carbide with a metal bonding matrix. Other materials, such as alloys or composites may be used in some applications.

DESCRIPTION OF THE PREFERRED EMBODIMENTS

Figure 1:
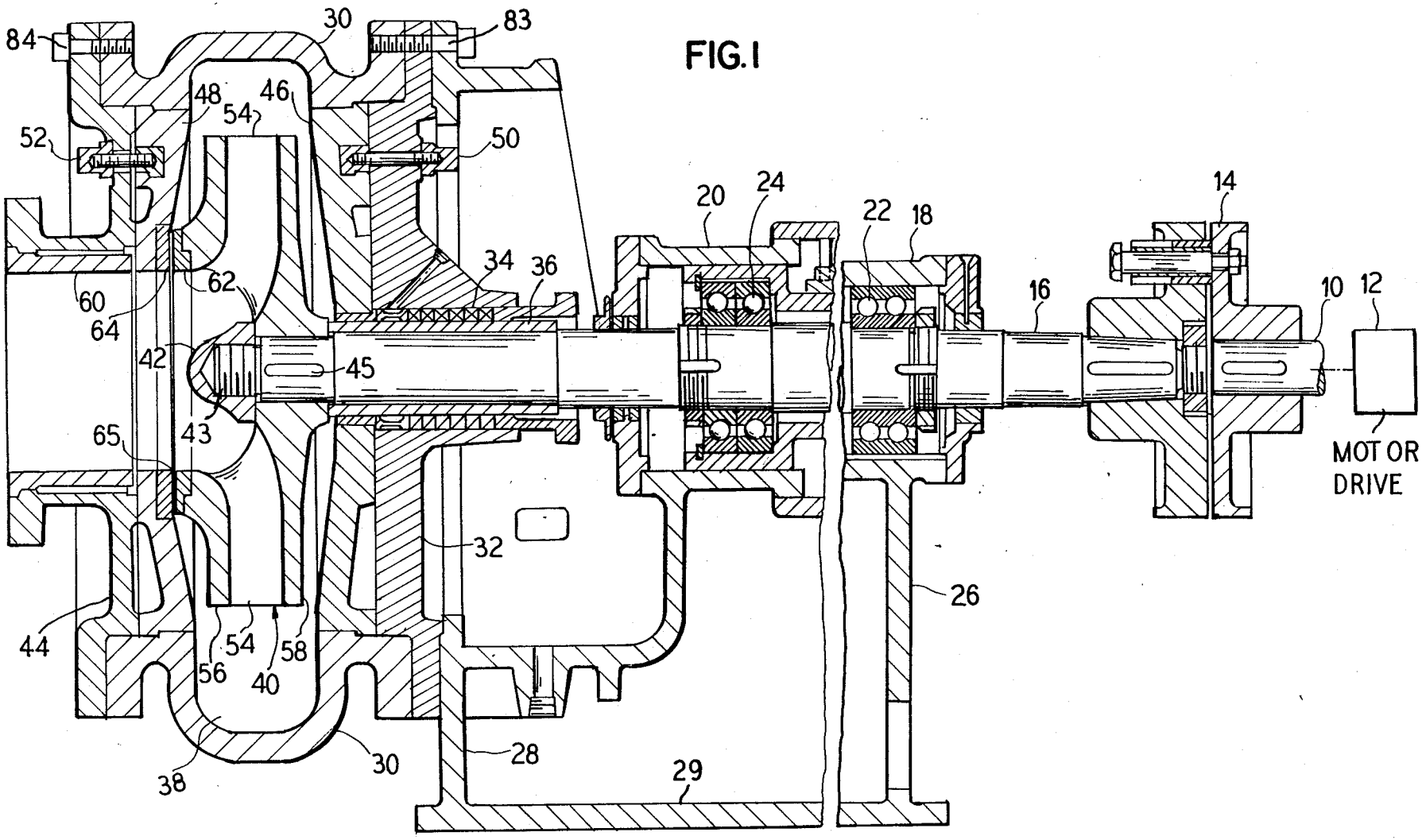
FIG. 1 is a cross section generally in an axial direction of a centrifugal pump according to the present invention and including wear resistant inserts.

A centrifugal slurry pump according to the principles of the present invention is shown in cross section in FIG. 1, including a horizontal drive shaft 10 driven by a drive motor 12 and connected through a coupling 14 to a pump shaft 16. The drive shaft 16 is rotatably mounted in a pair of spaced bearing assemblies 18 and 20 along the shaft 16. Each of the bearings assemblies 18 and 20 include respective bearings 22 and 24 and are connected by brackets 26 and 28 to a stationary mounting location such as a horizontal mounting plate 29, which together with the brackets 26 and 28 form a mounting pedestal.

At a free end of the pump shaft 16 is a pump housing 30 including a seal mounting flange 32 having a plurality of seals 34 extending between the seal flange 32 and a sleeve 36 on the pump drive shaft 16. A front portion of the pump housing 30 forms a volute chamber 38 within which is rotatably disposed an impeller 40 mounted on the free end of the pump drive shaft 16. A hub cover 42 is threaded over a threaded extension 43 of the pump drive shaft 16 to hold the impeller 40 in place and a key 45 assures that the impeller 40 rotates with the shaft 16. In the illustrated embodiment, an inlet housing 44 is mounted at the end of the pump housing 30 for connection to an inlet pipe (not shown).

In more detail, the preferred embodiment of the centrifugal slurry pump has a replaceable rear wear plate 46 forming a rear face of the volute impeller chamber 38 and a replaceable front wear plate 48 forming a front interior surface of the volute chamber 38. A plurality of bolts 50, one of which is shown in FIG. 1, mount the rear wear plate 46 in the pump housing 30. A plurality of bolts 83 and 84 as shown, hold the components together and permit disassembly for maintenance.

The impeller 40, when driven by the drive motor 12, rotates within the volute chamber 38 between the rear wear plate 46 and the front wear plate 48. The impeller 40 includes a plurality of impeller blades 54 extending substantially radially between a front impeller shroud 56 and a rear impeller shroud 58. The rotational motion of the impeller 40 within the volute chamber 38 generates a centrifugal force which draws liquid and/or slurry material through a centrally disposed inlet 60 in the inlet housing 454 and into the volute impeller chamber 38. As is known, the volute chamber 38 includes an outlet (not shown) through which pressurized liquid material is pumped. Although a single volute chamber is shown, it is, of course, possible that the pump chamber can be a double volute chamber. It is also possible that the impeller can have other shapes than that shown in FIG. 1.

During operation of the present pump, portions of the pump are subject to wear, particularly when a slurry or other liquid/solid mixture is being pumped. A centrifugal pump of the type shown has the greatest rate of wear on the inner portions of the front surfaces of the front impeller shroud 56 and on the opposing surface portions of the front wear plate 48. To reduce the rate of wear on these particular surface portions, the present invention provides inserts 62 and 64 of highly abrasion resistant material in the impeller 40 and the front wear plate 48 at these most wear prone locations in the centrifugal pump.

The operation of the drive motor 12 causes the pump shaft 16 to rotate the impeller 40 within the volute chamber 38, thereby generating a flow of liquid through the pump. When the liquid contains solid particles, such as, for example, when a slurry is being pumped, then the liquid-carried solids wear down the surfaces in contact with the flow. The higher the flow rate, the higher the wear rate. Wear occurs on the impeller 40 itself, on the rear wear plate 46, and on the front wear plate 48. However, the rate of wear on the front wear plate 48 for an exemplary centrifugal pump is approximately three times greater than the wear rate on the rear wear plate 46. This is due to a recirculation, or leakage, flow between the suction side of the impeller 40 and the outlet side of the impeller 40 which is caused by the high pressure differential. On the front wear plate 48, the region having the greatest wear rate is an area 65 of closest running tolerance between the face of the front impeller shroud 56 and an annular surface region of the front wear plate 48 immediately adjacent the inlet opening 60.

Figure 2:
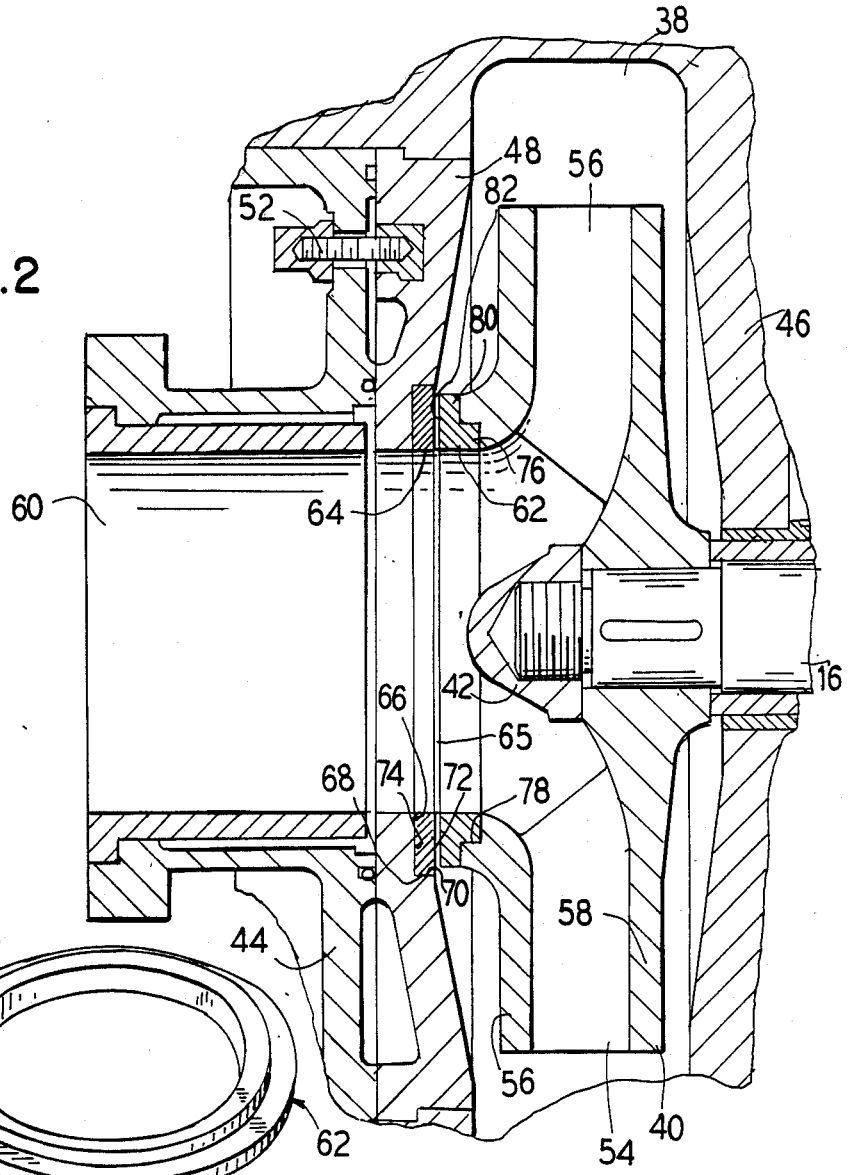
FIG. 2 is an enlarged fragmentary view of the impeller mounted within the pump housing from FIG. 1 having the annular wear resistant inserts.

Referring to FIG. 2, the rear wear plate 46 and the front wear plate 48 as well as the impeller 40 are generally formed of relatively durable, wear resistant materials, such as hardened steel and the like. However, even materials such as hardened steel undergo wear at a relatively fast rate in the region 65 in some slurry-pumping uses. Therefore, the inserts 62 and 64 of the present invention are formed of an extremely hard and durable ceramic composition so that the wear rate at the region 65 at least approximates that in other areas of the pump. Since ceramics in general, and particularly those which have the requisite hardness and durability for use in the present application, are expensive and quite difficult to form into complex shapes, the present invention provides that the quantity of material used for the present inserts is minimal and that the shapes are as simple as possible.

A further consideration is that such extremely hard ceramics generally are brittle and do not have sufficient strength in tension to with stand the stresses which occur inside a pump, particularly during pumping of a slurry. As such, the present inserts 62 and 64 are mounted at the wear prone region 65 in compression. More specifically, the front insert 64 is preferrably of a continuous annular shape of rectangular cross section and is mounted in compression in a similar size annular notch or channel 66 formed in the front wear plate 48. An outside surface 68 of the insert 64 tightly abuts a radially inwardly directed notch face 70 of the notch 66 to maintain the ceramic insert 64 in a stable, compressed condition. Irregularities in the notch 66 and insert 64, such as in shape and surface condition, should be eliminated to assure that the compression forces are substantially equal about the entire circumference of the annular insert 64.

When mounted as described, the insert 64 presents a wear face 72 directed toward the impeller 40. Fluid pressures in the region 65 act to compress the insert 64 axially against an axially directed notch face 74. Thus, the insert is in compression both radially and axially during operation of the pump.

The insert 62 is provided at an opposing face of the front impeller shroud 56 and is likewise mounted in compression. The insert 62 is of a continuous annular shape but differs from the insert 64 in that it has an "L-shaped" cross section. An axially directed leg 76 of the "L" is mounted in compression in an annular channel or notch 78 formed in the front shroud 56 of the impeller 40. The impeller insert 62 also includes a radially extending flange or leg 80 of the "L" extending across the front of the front shroud 56 and in axial compression due to fluid pressures in the region 65 acting on a face 82 of the insert 62.

It is preferred that the inserts 62 and 64 be mounted in compression in the pump of the present invention since a preferred material of which the inserts are formed is a hard ceramic material. One possibility for this hardened ceramic material is in the family of silicon carbide with a metal bonding matrix as made by Alanx Products, L.P. Such ceramic materials offer the advantages of extreme abrasion resistance and strength in compression, although weakness in tension. Of course, inserts of a material which does not require mounting in compression may be used, so long as resistance to abrasion and wear are provided.

An alternate means for mounting the inserts 62 and 64 is to provide a somewhat looser fit between the inserts 62 and 64 and the corresponding notches 78 and 66 and instead to bond the inserts 62 and 64 therein, such as by an epoxy adhesive. Other means for mounting the inserts 62 and 64 are also contemplated, including rivets or threaded fasteners.

Figure 3:
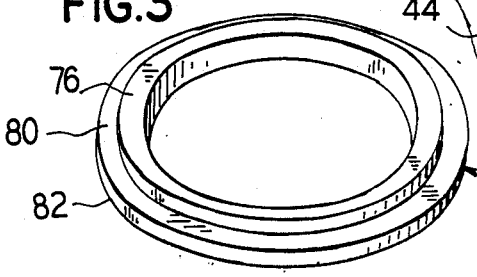
FIG. 3 is a perspective view of a wear resistant insert for use in the impeller shroud of the centrifugal pump shown in FIGS. 1 and 2.
Figure 4:
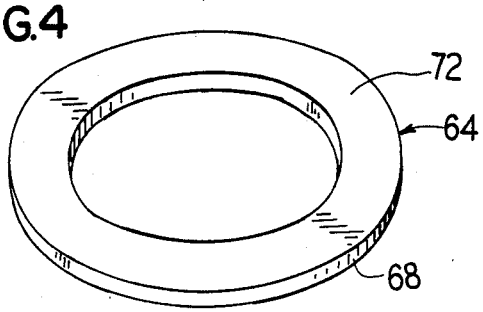
FIG. 4 is a perspective view of a second wear resistant insert for mounting opposite the insert of FIG. 3 in the centrifugal pump of FIGS. 1 and 2 according to the present invention.

Referring to FIGS. 3 and 4, the inserts 62 and 64 are shown before insertion in the respective notches 78 and 66 in the pump. They each have a relatively simple shape and are made with a minimal amount of the abrasion resistant material and are therefore economical. When the inserts 62 and 64 become worn or damaged, they can be easily replaced so that the efficiency of the pump is maintained without costly replacement of the impeller 40 and housing parts. However, due to the extreme hardness of the inserts 62 and 64, the wear rate is reduced considerably and replacement is much less frequent than with known devices.

As can be seen in FIG. 1, the drive shaft 16 rides on the bearings 24 which are spaced from the impeller 40 so that the impeller 40 is of a cantilevered design. A cantilevered centrifugal pump design permits larger solids to pass through the pump without damaging the impeller 40 and other pump components during pump being of a heavy slurry, for example, However, the impeller 40 is subject to lateral movements due, in part, to radial hydraulic forces and/or solids in the fluid flow acting on the impeller 40. Therefore, the front insert 64 of the preferred embodiment has the wear face 72 of greater diametrical extent then the opposing front face 82 of the insert 62 in the front shroud 56 of the impeller 40 to accommodate shaft runout or flexture due to the antilevered design of the disclosed pump. As a result, wear is prevented beyond the outside edge of the wear face 72, which preferrably extends at least to the maximum foreseeable lateral position of the wear face 82.

Thus, there is disclosed and shown an improved centrifugal slurry pump of a cantilevered design having wear resistant annular inserts 62 and 64 in the front shroud 56 of the impeller 40 and in the front wear face 48 in the pump housing 30. The disclosed pump provides optimum efficiency by controlling recirculation or leakage loss in the region 65 and, therefore, reducing energy costs in the operation of the pump. The present pump also reduces the maintenance time and cost in adjusting the impeller for optimum performance by axial adjustment of the bearings 24 in the housing 20, and in replacing worn parts of the impeller 40 and pump housing 30.

Although other modifications and changes may be suggested by those skilled in the art, it is the intention of the inventors to embody within the patent warranted hereon all changes and modifications as reasonably and properly come within the scope of their contribution to the art.

We claim:

1. A centrifugal cantilevered pump having a centrally located inlet lying on an axis, comprising:

a pump housing defining an impeller chamber, said pump housing having a generally circular inlet opening forming said inlet, said pump housing having a housing wear face extending around said inlet opening and facing said impeller chamber, an annular channel formed in said pump housing in said housing wear face, said annular channel being coaxial with said axis and encircling said inlet opening;

a pump drive shaft extending into said impeller chamber from a side of said pump housing opposite said inlet opening and mounted for rotation in said pump housing about said axis;

an impeller mounted on said pump drive shaft and being rotatable within said impeller chamber, said impeller including a plurality of impeller blades connected by front and back shrouds, said front shroud having an impeller wear face facing said housing wear face, an annular channel formed in said impeller wear face which is smaller in diameter than said annular channel in said housing wear face;

a first replaceable annular seal member of wear resistant ceramic material mounted in said annular channel on said housing wear face within said pump housing and encircling said inlet opening, an outermost surface of said first annular seal member being flush with a surface of said pump housing, said first seal member being mounted in compression and having said outermost surface being a seal face substantially perpendicular to said axis to permit runout of said cantilevered impeller; and a second replaceable annular seal member of wear resistant ceramic material mounted in said channel on said impeller wear face of said inlet front shroud of said impeller, portions of said second seal member extending radially beyond said channel in said impeller wear face and forming a seal face substantially perpendicular to said axis, said seal face of said second annular member being mounted opposite said seal face of said first annular seal member, said seal faces of said first and second seal members being closely adjacent one another to form a seal between said inlet of said of said pump and said impeller chamber to maintain a pressure differential across said seal during operation of said centrifugal pump; said first and second seal members being held in place in said housing and impeller channels solely by compression.

2. A centrifugal pump as claimed in claim 1, wherein said second annular replaceable seal member has a portion in said channel in said impeller wear face.

3. A centrifugal pump as claimed in claim 1, wherein said ceramic material is of silicon carbide with a bonded metal matrix.

4. A centrifugal pump as claimed in claim 1, wherein said first annular member has a wear face of greater diameter than an opposing wear face of said second annular member.

* * * * *